US008576126B2

(12) United States Patent
Hung et al.

(10) Patent No.: US 8,576,126 B2
(45) Date of Patent: Nov. 5, 2013

(54) DIPOLE ANTENNA AND ELECTRONIC DEVICE HAVING THE SAME

(75) Inventors: Tzu-Chieh Hung, Taipei (TW); Saou-Wen Su, Taipei (TW)

(73) Assignees: Lite-On Electronics (Guangzhou) Limited, Guangzhou (CN); Lite-On Technology Corp., Taipei (TW)

( * ) Notice: Subject to any disclaimer, the term of this patent is extended or adjusted under 35 U.S.C. 154(b) by 228 days.

(21) Appl. No.: 13/031,785

(22) Filed: Feb. 22, 2011

(65) Prior Publication Data

US 2011/0291898 A1 Dec. 1, 2011

(30) Foreign Application Priority Data

May 28, 2010 (CN) ..... 2010 1 0193791

(51) Int. Cl.
*H01Q 1/24* (2006.01)
*H01Q 1/52* (2006.01)

(52) U.S. Cl.
USPC ..... 343/702; 343/795; 343/851

(58) Field of Classification Search
USPC ..... 343/739, 740, 731, 732, 801, 802, 803, 343/806, 795
See application file for complete search history.

(56) References Cited

U.S. PATENT DOCUMENTS

| | | | | |
|---|---|---|---|---|
| 6,624,793 | B1 * | 9/2003 | Su et al. | 343/795 |
| 6,650,301 | B1 * | 11/2003 | Zimmerman | 343/803 |
| 7,098,863 | B2 * | 8/2006 | Bancroft | 343/859 |
| 7,183,984 | B2 * | 2/2007 | Jarmuszewski et al. | 343/702 |
| 7,183,994 | B2 * | 2/2007 | Weigand | 343/795 |
| 7,292,200 | B2 * | 11/2007 | Posluszny et al. | 343/803 |
| 7,548,214 | B2 * | 6/2009 | Chou et al. | 343/795 |
| 7,605,764 | B2 * | 10/2009 | Ishimiya | 343/702 |
| 2009/0128439 | A1 * | 5/2009 | Su et al. | 343/795 |
| 2009/0262030 | A1 * | 10/2009 | Zweers | 343/702 |
| 2009/0295646 | A1 * | 12/2009 | Oh et al. | 343/702 |
| 2010/0033380 | A1 * | 2/2010 | Pascolini et al. | 343/700 MS |
| 2010/0103061 | A1 * | 4/2010 | Yung et al. | 343/730 |

OTHER PUBLICATIONS

Kraus J. D. Electromagnetics—Capacitors and Capacitance—Section 2-21, Second Edition McGraw Hill 1973 pp. 49.*

* cited by examiner

*Primary Examiner* — Jerome Jackson, Jr.
*Assistant Examiner* — Ricardo Magallanes
(74) *Attorney, Agent, or Firm* — Rosenberg, Klein & Lee

(57) ABSTRACT

A dipole antenna includes interconnected first and second grounding portions, first and second connecting portions bending respectively from the first and second grounding portions in a substantially same direction, first and second extending portions extending respectively from the first connecting portion, and third and fourth extending portions extending respectively from the second connecting portion. The second extending portion is disposed closer to the first grounding portion than the first extending portion. The fourth extending portion is disposed closer to the second grounding portion than the third extending portion.

25 Claims, 15 Drawing Sheets

DIPOLE ANTENNA AND ELECTRONIC DEVICE HAVING THE SAME

CROSS-REFERENCE TO RELATED APPLICATION

This application claims priority of Chinese Application No. 201010193791.6, filed on May 28, 2010.

BACKGROUND OF THE INVENTION

1. Field of the Invention

The present invention relates to a dipole antenna, more particularly to a dipole antenna adapted for disposing in an electronic device.

2. Description of the Related Art

One of the frequency bands in which Wireless Local Area Networks (WLAN) operate is the 2.4 GHz frequency band. Antenna types that are generally used in the 2.4 GHZ frequency band include the sleeve dipole antenna, the printed antenna, and the chip antenna.

The sleeve dipole antenna is generally used as an external antenna and is often disposed externally on the housing of an electronic device (e.g., a portable computer, a router, or an access point). As a result, the electronic device is aesthetically compromised and the sleeve dipole antenna is vulnerable to external forces. The printed antenna and the chip antenna are generally used as internal antennas and are often disposed inside the housing of an electronic device. However, the printed antenna and the chip antenna must be disposed on a substrate (e.g., printed circuit board) and thus require allocation of valuable space inside the housing of the electronic device to accommodate the same.

SUMMARY OF THE INVENTION

Therefore, an object of the present invention is to provide a dipole antenna that can alleviate the aforesaid drawbacks of the prior art.

Accordingly, a dipole antenna of the present invention includes a grounding section, and first and second radiator sections.

The grounding section includes first and second grounding portions, each of which has opposite first and second ends. The second end of the first grounding portion is connected electrically to the first end of the second grounding portion.

The first radiator section includes a first connecting portion, and first and second extending portions. The first connecting portion bends from the first end of the first grounding portion. The first and second extending portions extend respectively from the first connecting portion in a direction toward the second end of the first grounding portion. The second extending portion is disposed closer to the first grounding portion than the first extending portion.

The second radiator section includes a second connecting portion, and third and forth extending portions. The second connecting portion bends from the second end of the second grounding portion in a substantially same direction relative to the first connecting portion. The third and fourth extending portions extend respectively from the second connecting portion in a direction toward the first end of the second grounding portion, the fourth extending portion being disposed closer to the second grounding portion than the third extending portion.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENTS

Figure 1:
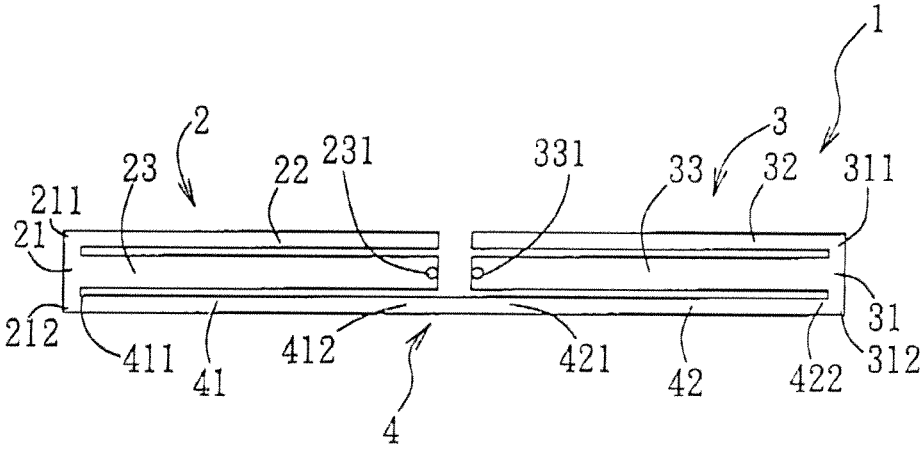
FIG. 1 is a schematic diagram illustrating the first preferred embodiment of a dipole antenna according to the present invention.

Before the present invention is described in greater detail, it should be noted that like elements are denoted by the same reference numerals throughout the disclosure.

Referring to FIG. 1, the first preferred embodiment of a dipole antenna 1 according to the present invention is a single-band dipole antenna formed integrally from a metal plate by conventional techniques, such as stamping and cutting. The dipole antenna 1 includes first and second radiator sections 2, 3, and a grounding section 4. The grounding section 4 includes first and second grounding portions 41, 42, each of which has a first end 411, 421 and a second end 412, 422 opposite to the first end 411, 421. The second end 412 of the first grounding portion 41 is connected electrically to the first end 421 of the second grounding portion 42.

The first radiator section 2 includes a first connecting portion 21 that bends and extends substantially perpendicularly from the first end 411 of the first grounding portion 41, and first and second extending portions 22, 23 that extend respectively from the first connecting portion 21 in a direction toward the second end 412 of the first grounding portion 41. The first and second extending portions 22, 23 are substantially parallel to the first grounding portion 41. The second extending portion 23 is disposed closer to the first grounding portion 41 than the first extending portion 22.

The second radiator section 3 includes a second connecting portion 31 that bends and extends substantially perpendicularly from the second end 422 of the second grounding portion 42 in a substantially same direction relative to the first connecting portion 21, and third and fourth extending portions 32, 33 that extend respectively from the second connecting portion 31 in a direction toward the first end 421 of the second grounding portion 42. The third and fourth extending portions 32, 33 are substantially parallel to the second grounding portion 42. The fourth extending portion 33 is disposed closer to the second grounding portion 42 than the third extending portion 32.

The first extending portion 22 is spaced apart from the third extending portion 32 by a first distance. The second extending portion 23 is spaced apart from the fourth extending portion 33 by a second distance. In the present embodiment, the first distance is equal to the second distance. However, the first and second distances may be individually adjusted to thereby adjust coupling between the first and second radiator sections 2, 3 to subsequently adjust resonant band of the dipole antenna 1. It is to be noted that, in addition to adjusting the first and second distances, length of each of the first and second grounding portions 41, 42 may also be adjusted for adjustment of the resonant band of the dipole antenna 1.

Furthermore, the second extending portion 23 is spaced apart from the first extending portion 22 by a first gap, and from the first grounding portion 41 by a second gap. The fourth extending portion 33 is spaced apart from the third extending portion 32 by a third gap, and from the second grounding portion 42 by a fourth gap. In the present embodiment, the first, second, third, and fourth gaps are equal to one another in width. However, in an embodiment, width of the first gap is equal to that of the third gap, and width of the second gap is equal to that of the fourth gap. In yet another embodiment, width of the first gap is equal to that of the second gap, and width of the third gap is equal to that of the fourth gap.

The second extending portion 23 has a distal end 231 distal from the first connecting portion 21, the fourth extending portion 33 has a distal end 331 distal from the second connecting portion 31, one of the distal ends 231, 331 of the second and fourth extending portions 23, 33 serves as a feed-in point for feeding of signals, and the other of the distal ends 231, 331 of the second and fourth extending portions 23, 33 serves as a grounding point for grounding. The feed-in point and the grounding point are to be connected electrically to a signal source on a printed circuit board and a ground plane of an electronic device, respectively.

Figure 2:
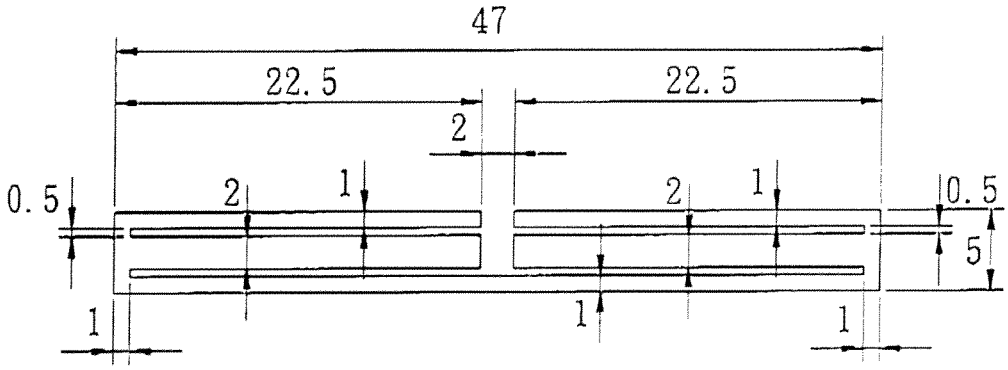
FIG. 2 is a schematic diagram illustrating planar dimensions of the dipole antenna of the first preferred embodiment.
Figure 3:
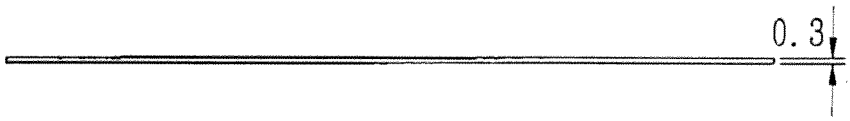
FIG. 3 is a schematic diagram illustrating thickness of the dipole antenna of the first preferred embodiment.

FIG. 2 is a schematic diagram illustrating planar dimensions (in millimeters, mm) of the dipole antenna 1 of the first preferred embodiment, and FIG. 3 is a schematic diagram illustrating thickness (in mm) of the same. It is to be noted that, in the present embodiment, the second distance between the second and fourth extending portions 23, 33 may be adjusted within the range from 0 mm to 5 mm according to design need.

Figure 4:
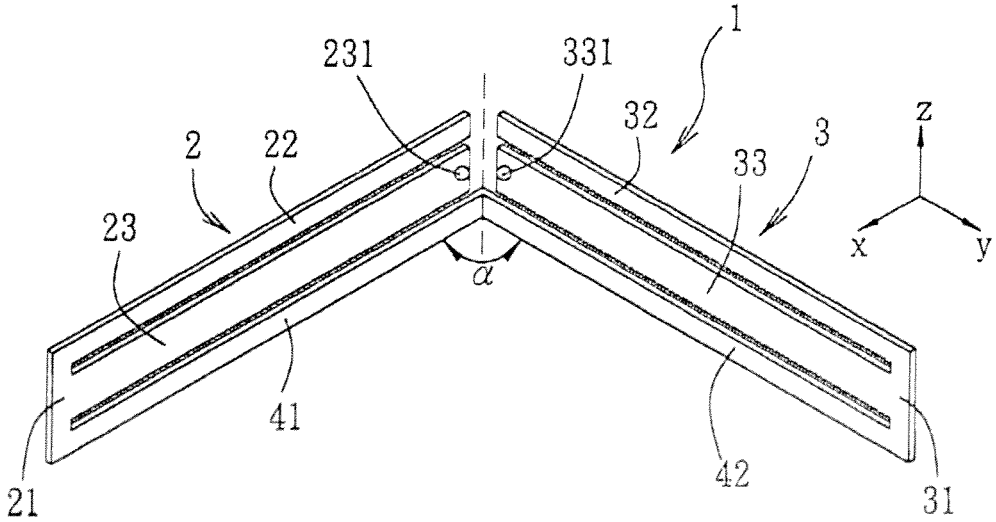
FIG. 4 is a perspective view of the dipole antenna of the first preferred embodiment, first and second radiator sections of the dipole antenna forming a first angle therebetween.

FIG. 4 is a perspective view of the dipole antenna 1. The first grounding portion 41, the first connecting portion 21, and the first and second extending portions 22, 23 are disposed on a first plane. The second grounding portion 42, the second connecting portion 31, and the third and fourth extending portions 32, 33 are disposed on a second plane. The first and second planes form a first angle $\alpha$ therebetween that is greater than 0 degree and not greater than 180 degrees. The first angle $\alpha$ is 90 degrees in FIG. 4, and is 180 degrees in FIG. 1.

Figure 5:
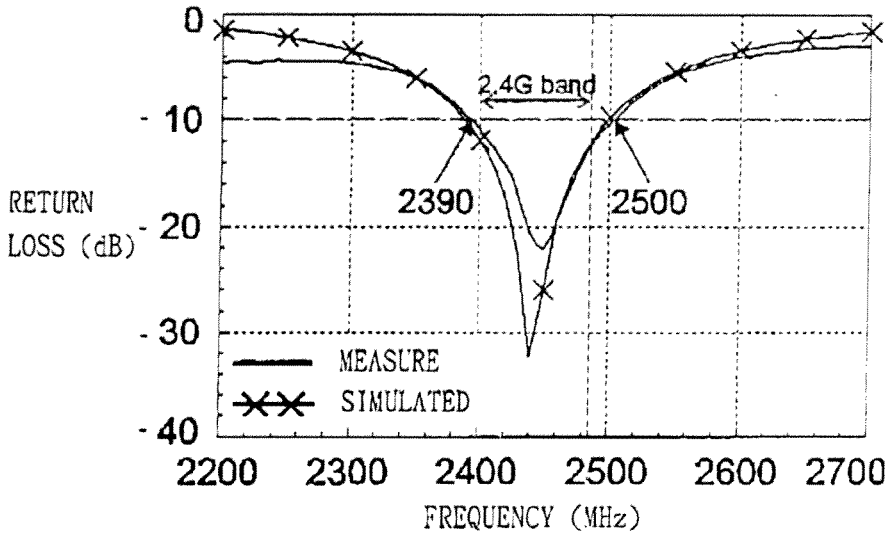
FIG. 5 is a plot illustrating measured return loss and simulated return loss of the dipole antenna of the first preferred embodiment at frequencies ranging from 2200 MHz to 2700 MHz when the first angle is 90 degrees.

FIG. 5 is a plot illustrating measured return loss and simulated return loss of the dipole antenna 1 at frequencies ranging from 2200 MHz to 2700 MHz when the first angle $\alpha$ is 90 degrees. The dipole antenna 1 has a bandwidth of 110 MHz (from 2390 MHz to 2500 MHz) at a return loss of 10 dB (i.e., a VSWR value of 2:1).

Figure 6:
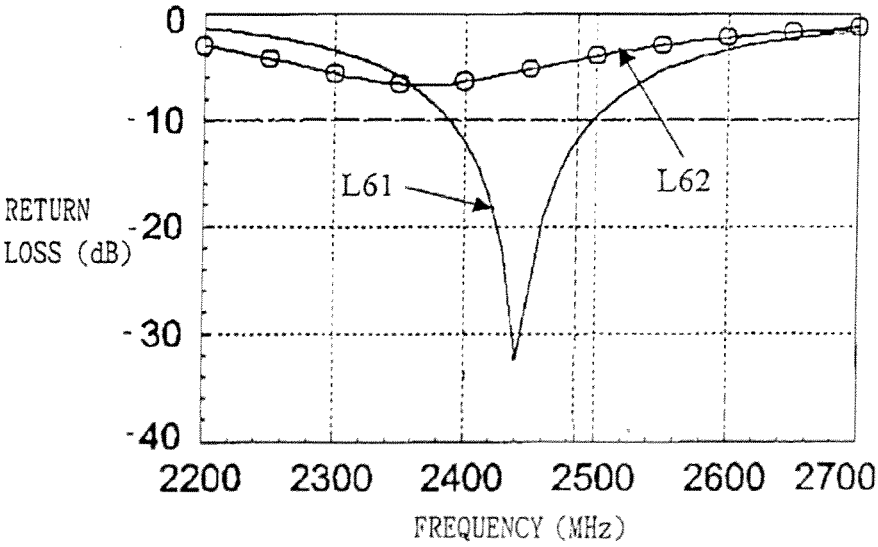
FIG. 6 is a plot illustrating the simulated return loss of the dipole antenna of the first preferred embodiment and simulated return loss of a comparative example without a grounding section, at frequencies ranging from 2200 MHz to 2700 MHz.

FIG. 6 is a plot illustrating the simulated return loss of the dipole antenna 1 of the first preferred embodiment and that of a comparative example without a grounding section (i.e., the first and second grounding portions 41, 42 of the dipole antenna 1), at frequencies ranging from 2200 MHz to 2700 MHz. Lines L61 and L62 represent the simulated return loss of the dipole antenna 1 and that of the comparative example, respectively. It is apparent from FIG. 6 that the dipole antenna 1 performs better than the comparative example at frequencies ranging from 2390 MHz to 2500 MHz.

Figure 7:
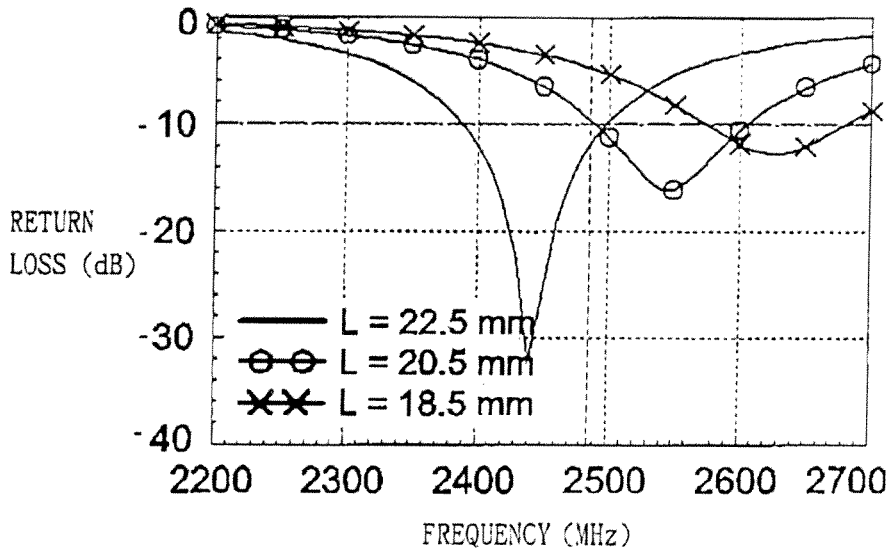
FIG. 7 is a plot illustrating the simulated return loss of the dipole antenna of the first preferred embodiment with different lengths of first and third extending portions of the first and second radiator sections.

FIG. 7 is a plot illustrating the simulated return loss of the dipole antenna 1 with different configurations of the first distance, i.e., with lengths of the first and third extending portions 22, 32 being set as 18.5 mm, 20.5 mm, or 22.5 mm. The frequency at which the dipole antenna 1 operates may be increased by reducing the lengths of the first and third extending portions 22, 32. In addition, it is worth noting that return loss of the dipole antenna 1 may be decreased by reducing the first distance.

Figure 8:
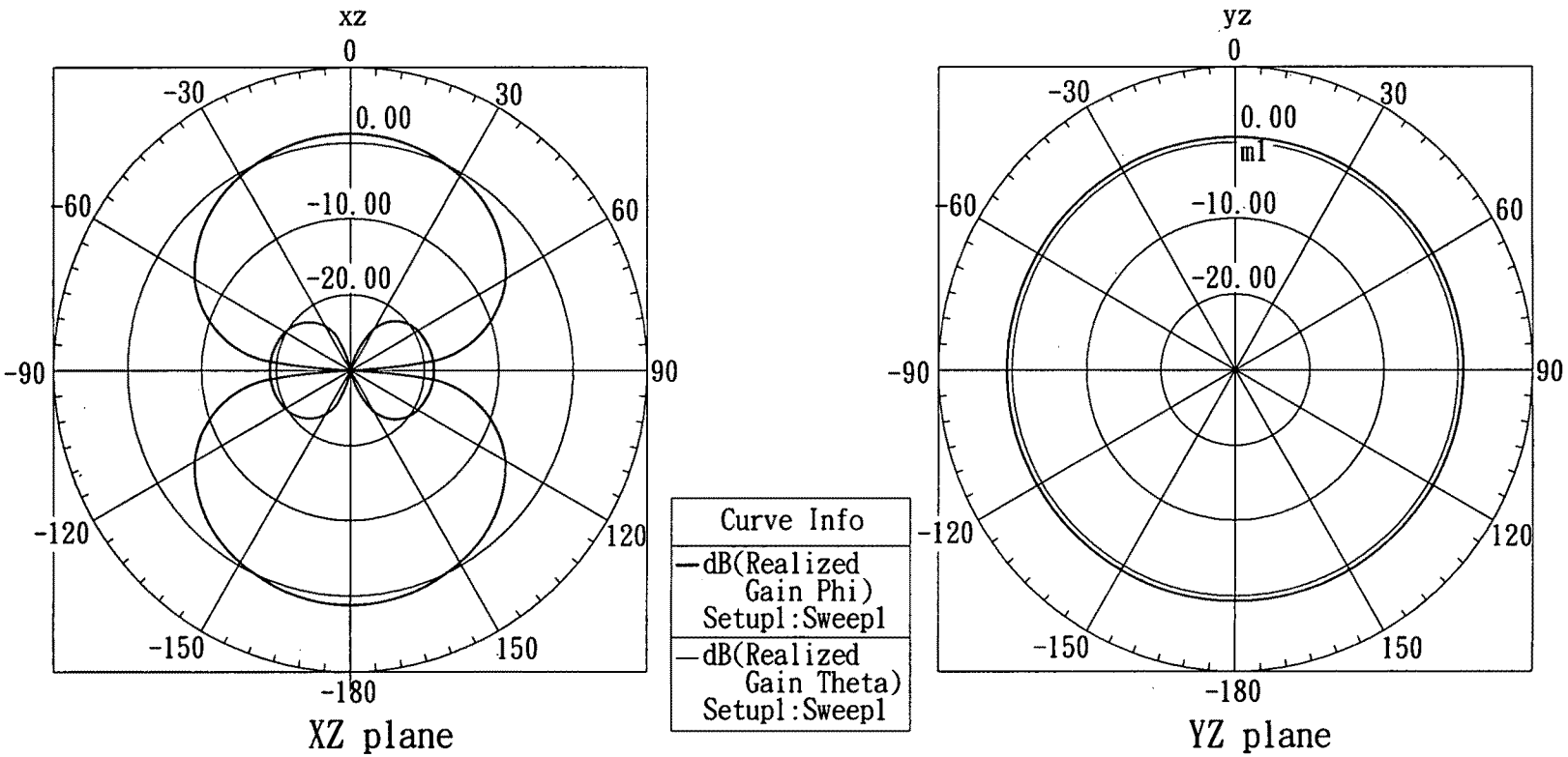
FIG. 8 illustrates radiation patterns of the dipole antenna of the first preferred embodiment in each of the XZ and YZ planes when the first angle is 180 degrees.
Figure 9:
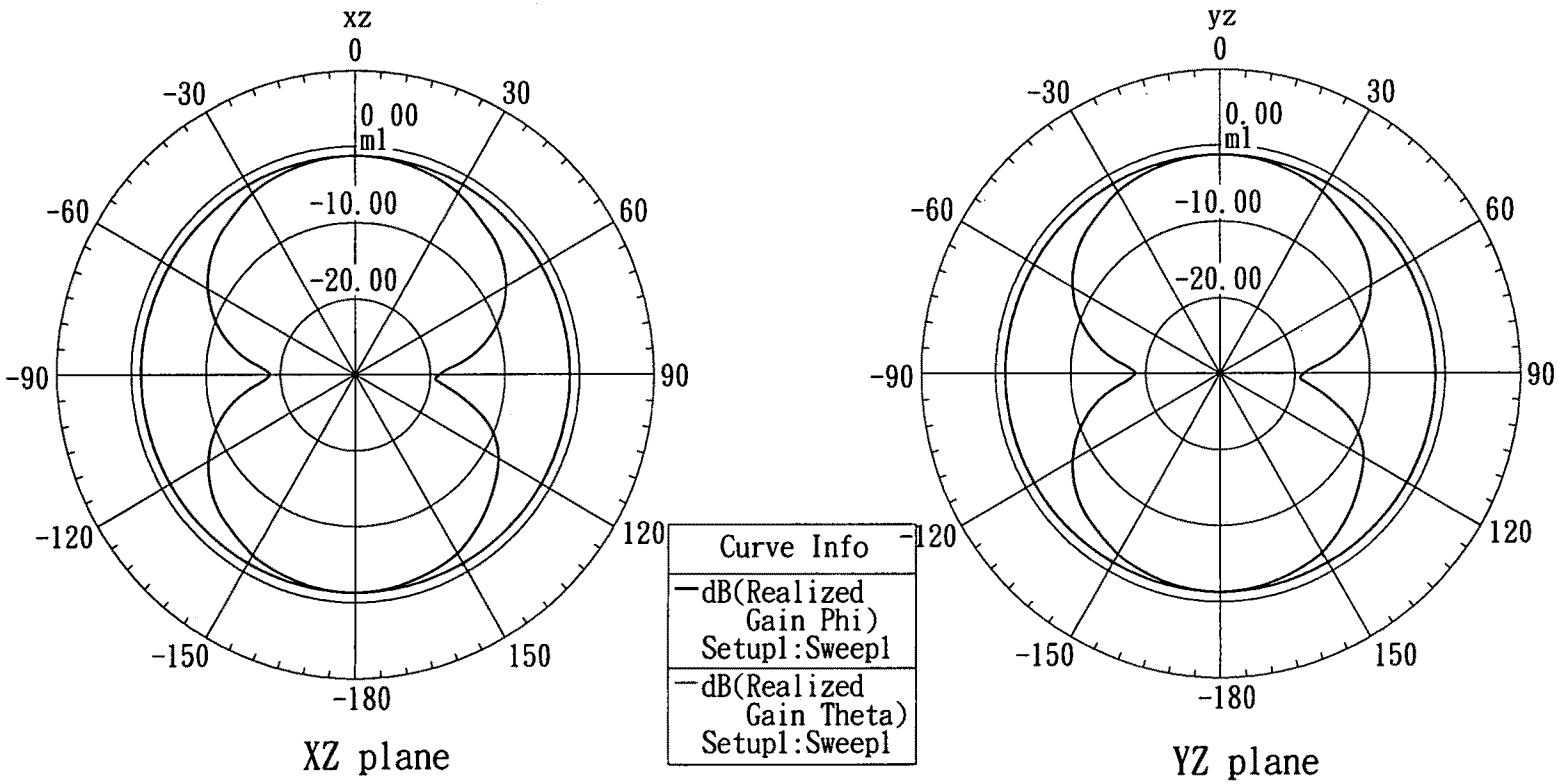
FIG. 9 illustrates radiation patterns of the dipole antenna of the first preferred embodiment in each of the XZ and YZ planes when the first angle is 90 degrees.

FIGS. 8 and 9 are radiation patterns of the dipole antenna 1 when the first angle $\alpha$ is 180 degrees and 90 degrees, respectively, each of the radiation patterns being viewed in the XZ and YZ planes.

Figure 10:
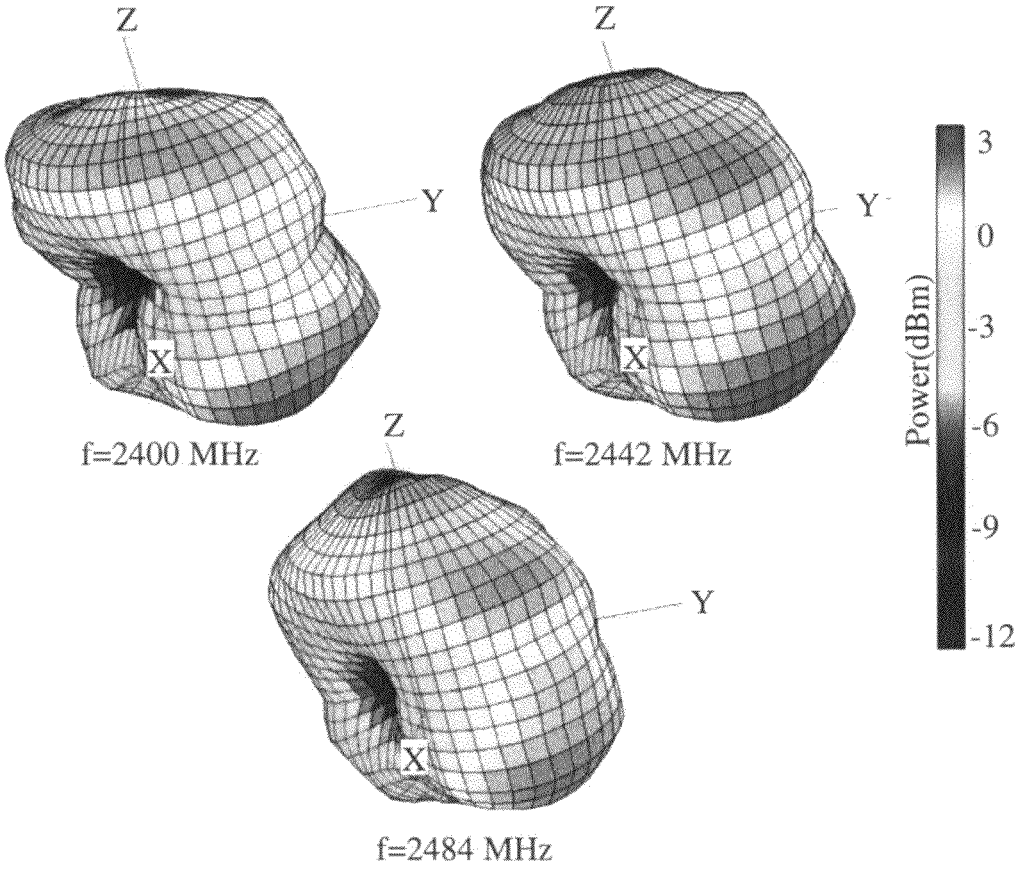
FIG. 10 illustrates three-dimensional radiation patterns of the dipole antenna of the first preferred embodiment at respective frequencies of 2400 MHz, 2442 MHz, and 2484 MHz when the first angle is 90 degrees.

FIG. 10 illustrates three-dimensional radiation patterns of the dipole antenna 1 at respective frequencies of 2400 MHz, 2442 MHz, and 2484 MHz when the first angle $\alpha$ is 90 degrees. The radiation patterns are uniform and stable within the operating frequency range of the dipole antenna 1.

Figure 11:
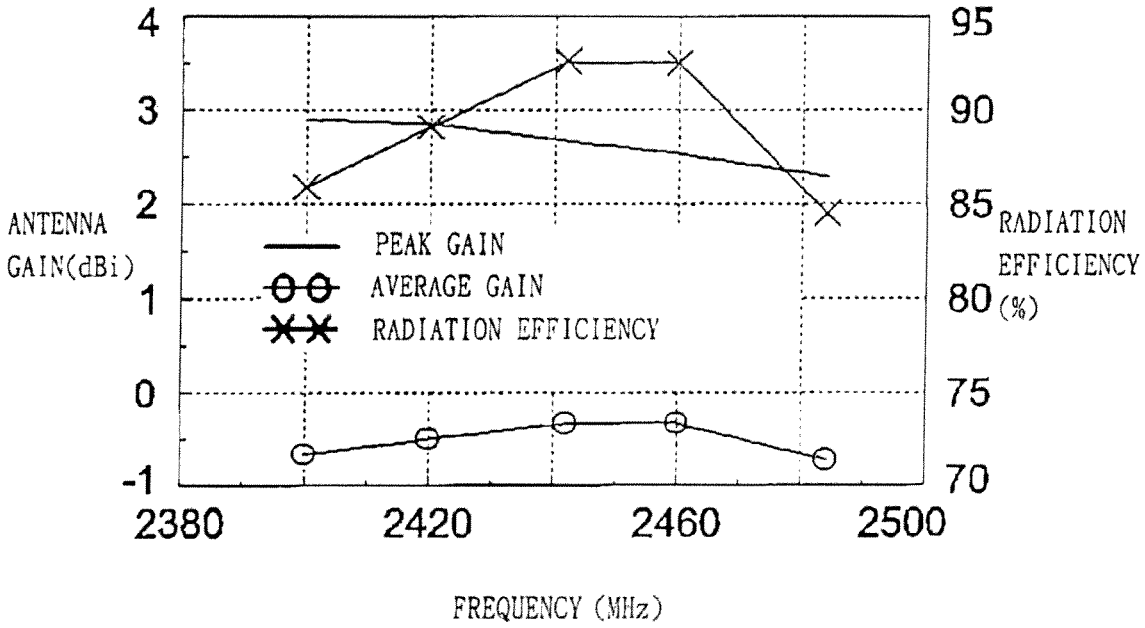
FIG. 11 is a plot illustrating peak gain and average gain (in decibel isotropic, dBi), and radiation efficiency (in percentage, %) of the dipole antenna of the first preferred embodiment at frequencies ranging from 2380 MHz to 2500 MHz when the first angle is 90 degrees.

FIG. 11 is a plot illustrating peak gain and average gain (in decibel isotropic, dBi), and radiation efficiency (in percentage, %) of the dipole antenna 1 at frequencies ranging from 2380 MHz to 2500 MHz when the first angle $\alpha$ is 90 degrees. At a frequency of 2442 MHz, the peak gain can reach 2.7 dBi, the average gain is about −0.3 dBi (i.e., the peak gain is about 3 dB higher than the average gain), and the radiation efficiency is over 85%.

The other preferred embodiments of this invention are similar the first preferred embodiment, differences among which a described hereinafter.

Figure 12:
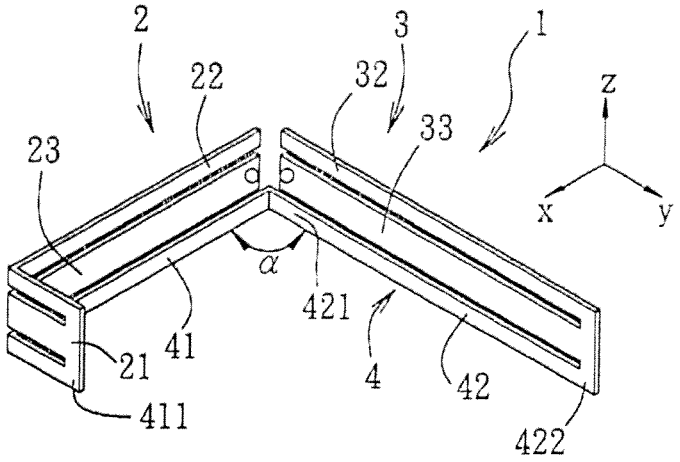
FIGS. 12 to 18 are perspective views of the second, third, fourth, fifth, sixth, seventh, and eighth preferred embodiments of a dipole antenna according to the present invention, respectively.

Referring to FIG. 12, in comparison with the first preferred embodiment, each of the first and second extending portions 22, 23 in the second preferred embodiment has one end connected electrically to the first connecting portion 21. The first end 411 of the first grounding portion 41, said one end of the first extending portion 22, and said one end of the second extending portion 23 are bent to extend substantially in a direction from the first end 421 to the second end 422 of the second grounding portion 42.

Figure 13:
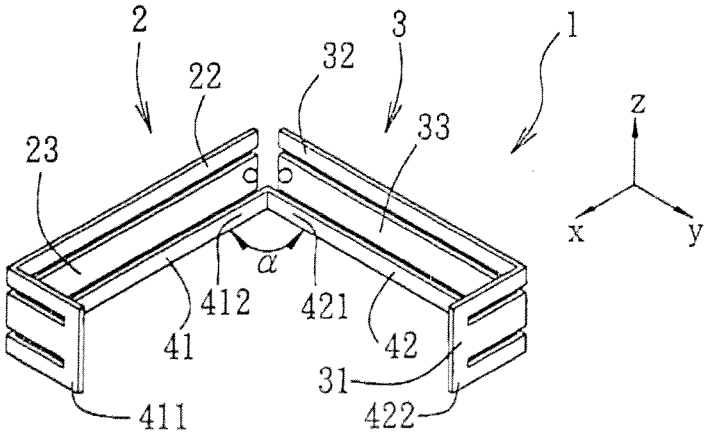

Referring to FIG. 13, in comparison with the second preferred embodiment, each of the third and fourth extending portions 32, 33 in the third preferred embodiment has one end connected electrically to the second connecting portion 31. The second end 422 of the second grounding portion 42, said one end of the third extending portion 32, and said one end of the fourth extending portion 33 are bent to extend substantially in a direction from the second end 412 to the first end 411 of the first grounding portion 41.

Figure 14:
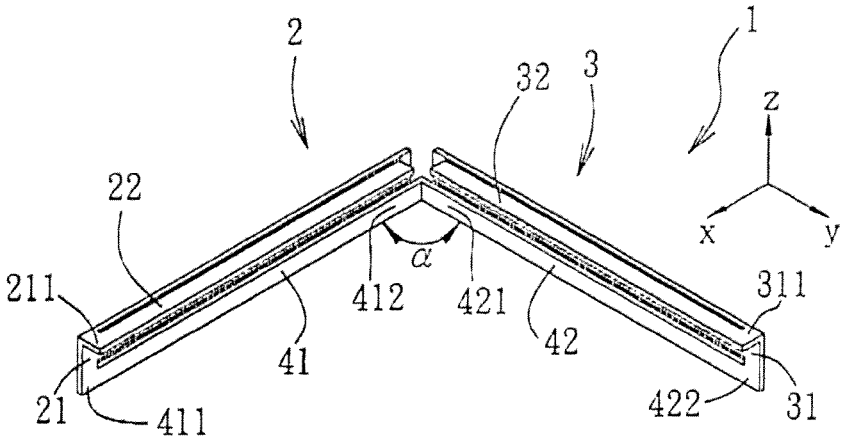

Referring to FIG. 14, in comparison with the first preferred embodiment, the first connecting portion 21 in the fourth preferred embodiment has a first end 211 to which the first extending portion 22 is electrically connected. The first end 211 of the first connecting portion 21 is bent to extend substantially in the direction from the first end 421 to the second end 422 of the second grounding portion 42. The second connecting portion 31 in the fourth preferred embodiment has a first end 311 to which the third extending portion 32 is electrically connected. The first end 311 of the second connecting portion 31 is bent to extend substantially in the direction from the second end 412 to the first end 411 of the first grounding portion 41.

Figure 15:
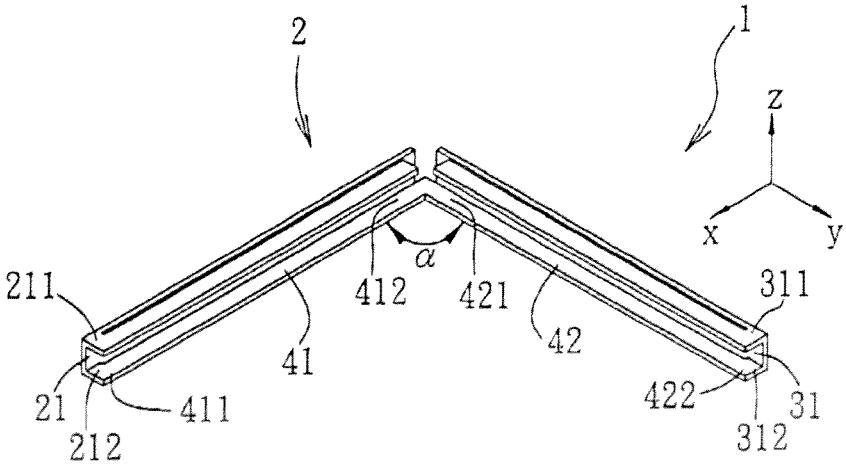

Referring to FIG. 15, in comparison with the fourth preferred embodiment, the first connecting portion 21 in the fifth preferred embodiment further has a second end 212 opposite to the first end 211 thereof and connected electrically to the first end 411 of the first grounding portion 41. The second end 212 of the first connecting portion 21 is bent to extend substantially in the direction from the first end 421 to the second end 422 of the second grounding portion 42. The second connecting portion 31 in the fifth preferred embodiment further has a second end 312 opposite to the first end 311 thereof and connected electrically to the second end 422 of the second grounding portion 42. The second end 312 of the second connecting portion 31 is bent to extend substantially in the direction from the second end 412 to the first end 411 of the first grounding portion 41.

Figure 16:
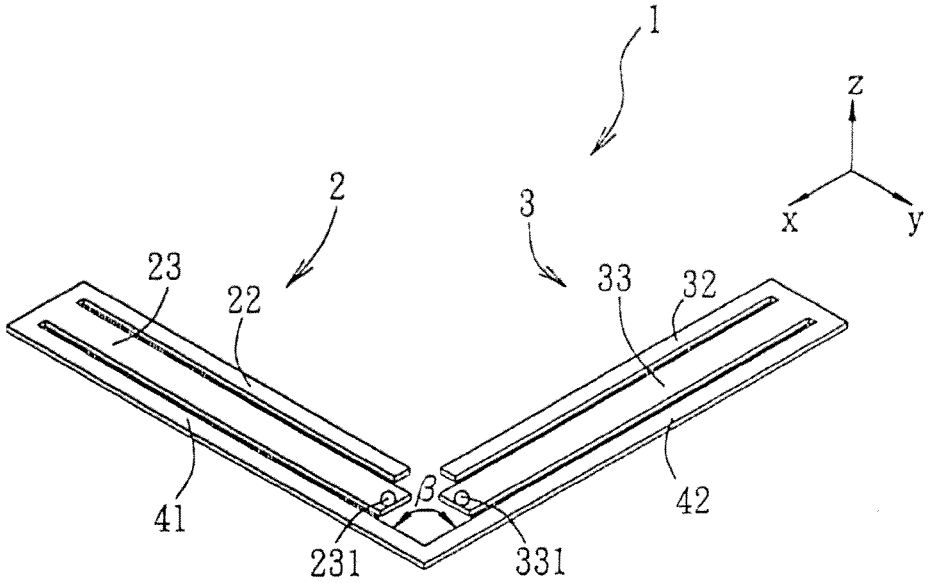
Figure 17:
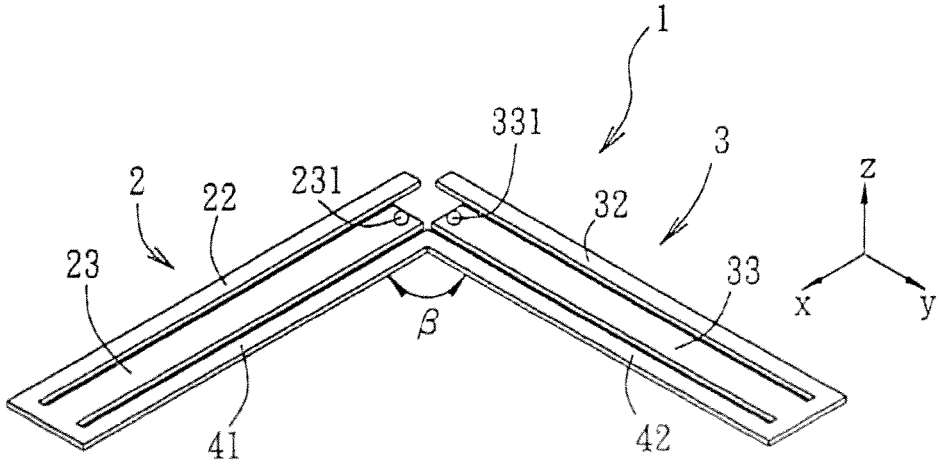
Figure 18:
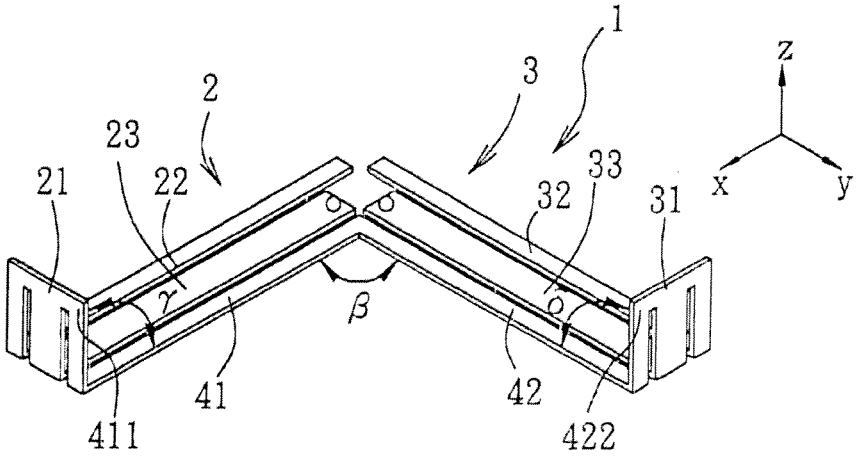

Shown in FIGS. 16, 17, 18 are dipole antennas 1 of the sixth, seventh, and eighth preferred embodiments, respectively, each of the first and second grounding portions 41, 42, the first and second connecting portions 21, 31, and the first, second, third, and fourth extending portions 22, 23, 32, 33 having at least one segment disposed on a third plane. The first and second grounding portions 41, 42 form a second angle β therebetween that is greater than 0 degree and not greater than 180 degrees. In the sixth, seventh, and eighth preferred embodiments, the second angle β is 90 degrees.

In the eighth preferred embodiment, each of the first and second extending portions 22, 23 has one end connected electrically to the first connecting portion 21. The first end 411 of the first grounding portion 41, said one end of the first extending portion 22, and said one end of the second extending portion 23 are bent to extend substantially in a fourth plane. The fourth plane forms a third angle γ with the third plane. Each of the third and fourth extending portions 32, 33 has one end connected electrically to the second connecting portion 31. The second end 422 of the second grounding portion 42, said one end of the third extending portion 32, and said one end of the fourth extending portion 33 are bent to extend in a fifth plane in substantially the same direction relative to the first end 411 of the first grounding portion 41, said one end of the first extending portion 22, and said end of the second extending portion 23. The fifth plane forms a fourth angle δ with the third plane. The third and fourth angles γ, δ are 90 degrees in this embodiment. It is to be noted that, in other embodiments, one of the fourth and fifth planes may be coplanar with the third plane.

Figure 19:
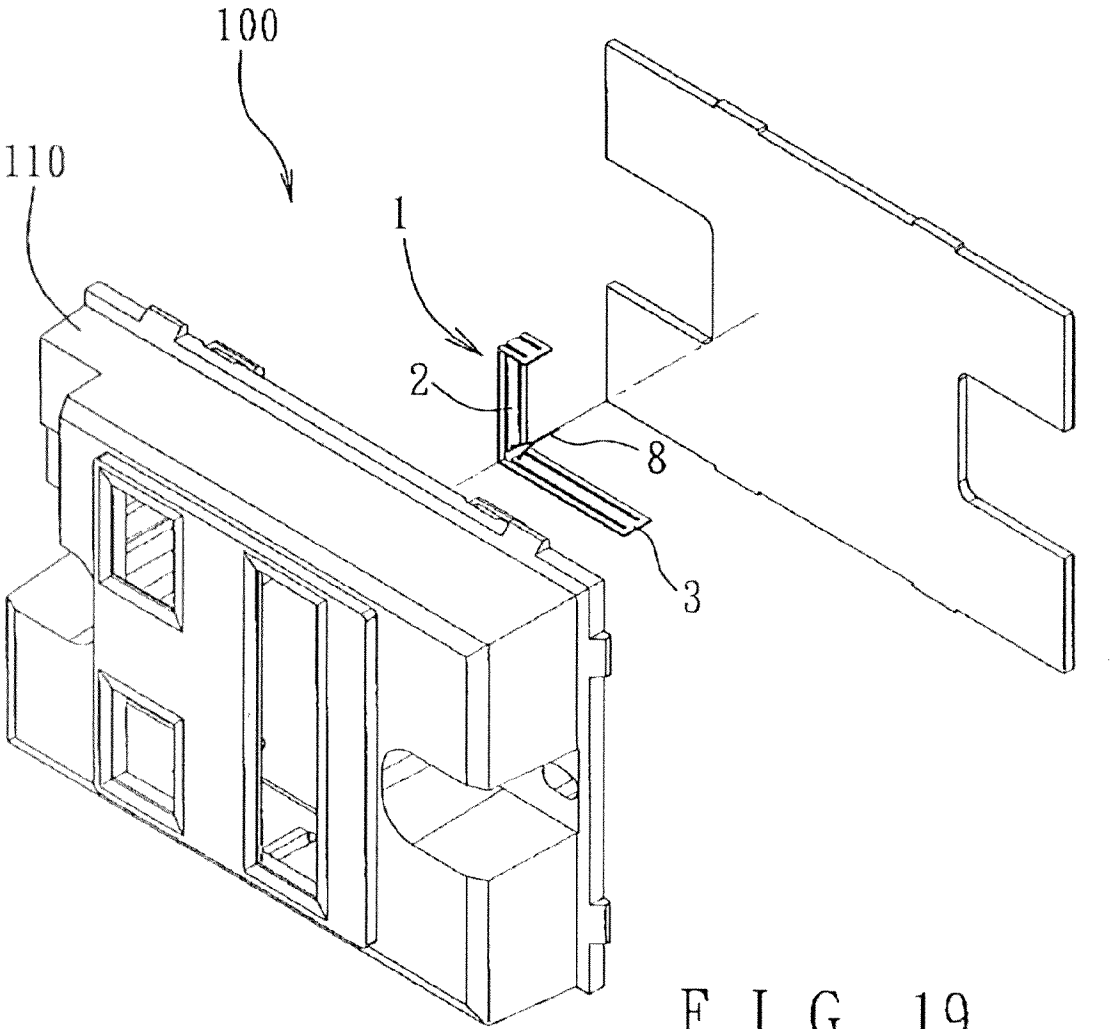
FIG. 19 is an exploded perspective view of the dipole antenna of the second preferred embodiment and a housing of an electronic device to illustrate the assembly relation of the dipole antenna and the housing.
Figure 20:
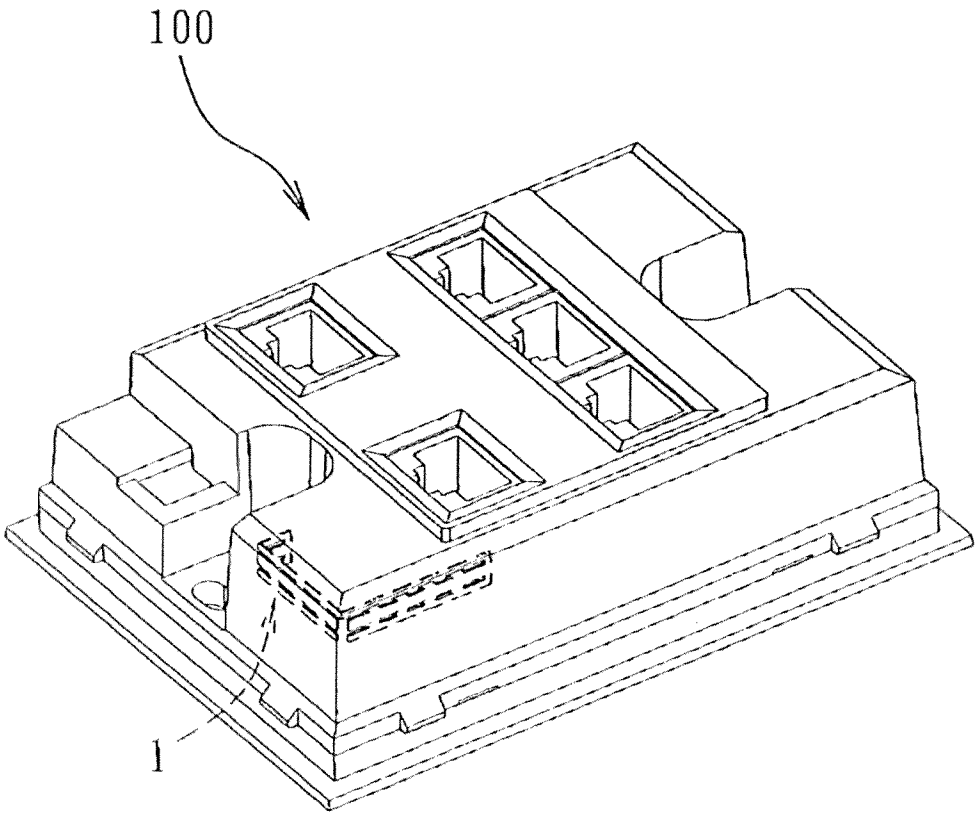
FIG. 20 is a perspective view of the dipole antenna of the second preferred embodiment disposed inside the housing of the electronic device.

Referring to FIGS. 19 and 20, the dipole antenna 1 of the second preferred embodiment is disposed in a housing 110 of an electronic device 100, and the feed-in point and the grounding point of the dipole antenna 1 are connected electrically to a coaxial cable 8 for signal transmission. The dipole antenna 1 is disposed to extend along a peripheral wall of the housing 110 so as to minimize space occupied thereby in the housing 110. The electronic device 100 may be a monitor, a notebook computer, an access point, a hub, a router, etc. The dipole antenna 1 of this invention is configured for operating in the 2.4 GHz frequency band so as to be suited for application to Wireless Local Area networks (WLAN). In other embodiments, the dipole antenna 1 may be configured for operating in other frequency bands.

In summary, the dipole antennas 1 of the preferred embodiments are formed integrally from a metal plate to reduce manufacturing costs, the first and second distances and the lengths of the first and second grounding portions may be individually adjusted to thereby adjust the resonant band, and the shapes of which are adaptable for disposing in different housings of different electronic devices.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A dipole antenna comprising:

a grounding section including first and second grounding portions, each of which has opposite first and second ends, said second end of said first grounding portion being connected electrically to said first end of said second grounding portion;

a first radiator section including a first connecting portion extending perpendicularly from said first end of said first grounding portion, and first and second extending portions that transversely extend respectively from said first connecting portion in a direction toward said second end of said first grounding portion, said second extending portion being disposed between said first grounding portion and said first extending portion; and a second radiator section including a second connecting portion extending perpendicularly from said second end of said second grounding portion in a substantially same direction relative to said first connecting portion, and third and fourth extending portions that transversely extend respectively from said second connecting portion in a direction toward said first end of said second grounding portion, said fourth extending portion being disposed between said second grounding portion and said third extending portion.

2. The dipole antenna as claimed in claim 1, wherein said first extending portion is spaced apart from said third extending portion by a first distance, and said second extending portion is spaced apart from said fourth extending portion by a second distance.

3. The dipole antenna as claimed in claim 2, wherein said first connecting portion extends substantially perpendicularly from said first end of said first grounding portion, and said second connecting portion extends substantially perpendicularly from said second end of said second grounding portion.

4. The dipole antenna as claimed in claim 3, wherein said first distance is equal to said second distance.

5. The dipole antenna as claimed in claim 1, wherein:

said second extending portion is spaced apart from said first extending portion by a first gap, and from said first grounding portion by a second gap; and said fourth extending portion is spaced apart from said third extending portion by a third gap, and from said second grounding portion by a fourth gap.

6. The dipole antenna as claimed in claim 5, wherein width of said first gap is equal to that of said third gap, and width of said second gap is equal to that of said fourth gap.

7. The dipole antenna as claimed in claim 5, wherein width of said first gap is equal to that of said second gap, and width of said third gap is equal to that of said fourth gap.

8. The dipole antenna as claimed in claim 1, wherein:

said first grounding portion, said first connecting portion, and said first and second extending portions are disposed on a first plane;

said second grounding portion, said second connecting portion, and said third and fourth extending portions are disposed on a second plane; and the first and second planes form a first angle therebetween that is greater than 0 degree and not greater than 180 degrees.

9. The dipole antenna as claimed in claim 8, wherein the first angle is 90 degrees.

10. The dipole antenna as claimed in claim 8, wherein each of said first and second extending portions has one end connected electrically to said first connecting portion, said first end of said first grounding portion, said one end of said first extending portion, and said one end of said second extending portion being bent to extend substantially in a direction from said first end of said second grounding portion to said second end of said second grounding portion.

11. The dipole antenna as claimed in claim 10, wherein each of said third and fourth extending portions has one end connected electrically to said second connecting portion, said second end of said second grounding portion, said one end of said third extending portion, and said one end of said fourth extending portion being bent to extend substantially in a direction from said second end of said first grounding portion to said first end of said first grounding portion.

12. The dipole antenna as claimed in claim 9, wherein:

said first connecting portion has a first end to which said first extending portion is electrically connected, said first end of said first connecting portion being bent to extend substantially in a direction from said first end of said second grounding portion to said second end of said second grounding portion; and said second connecting portion has a first end to which said third extending portion is electrically connected, said first end of said second connecting portion being bent to extend substantially in a direction from said second end of said first grounding portion to said first end of said first grounding portion.

13. The dipole antenna as claimed in claim 12, wherein:

said first connecting portion further has a second end opposite to said first end thereof and connected electrically to said first end of said first grounding portion, said second end of said first connecting portion being bent to extend substantially in the direction from said first end of said second grounding portion to said second end of said second grounding portion; and said second connecting portion further has a second end opposite to said first end thereof and connected electrically to said second end of said second grounding portion, said second end of said second connecting portion being bent to extend substantially in the direction from said second end of said first grounding portion to said first end of said first grounding portion.

14. The dipole antenna as claimed in claim 1, wherein each of said first and second grounding portions, said first and second connecting portions, and said first, second, third, and fourth extending portions has at least one segment disposed on a third plane.

15. The dipole antenna as claimed in claim 14, wherein said first and second grounding portions form a second angle therebetween that is greater than 0 degree and not greater than 180 degrees.

16. The dipole antenna as claimed in claim 15, wherein the second angle is 90 degrees.

17. The dipole antenna as claimed in claim 15, wherein each of said first and second extending portions has one end connected electrically to said first connecting portion, said first end of said first grounding portion, said one end of said first extending portion, and said one end of said second extending portion being bent to extend substantially in a fourth plane, the fourth plane forming a third angle with the third plane.

18. The dipole antenna as claimed in claim 17, wherein each of said third and fourth extending portions has one end connected electrically to said second connecting portion, said second end of said second grounding portion, said one end of said third extending portion, and said one end of said fourth extending portion being bent to extend in a fifth plane in substantially the same direction relative to said first end of said first grounding portion, said one end of said first extending portion, and said one end of said second extending portion, the fifth plane forming a fourth angle with the third plane.

19. The dipole antenna as claimed in claim 1, wherein said grounding section, said first radiator section and said second radiator section are formed integrally from a metal plate.

20. The dipole antenna as claimed in claim 1, wherein said first and said second extending portions are disposed at the same side as said first grounding portion and said third and said fourth extending portions are disposed at the same side as said second grounding portion.

21. The dipole antenna as claimed in claim 20, wherein said second extending portion has a distal end distal from said first connecting portion, said fourth extending portion has a distal end distal from said second connecting portion, one of said distal ends of said second and fourth extending portions serves as a feed-in point for feeding of signals, and the other of said distal ends of said second and fourth extending portions serves as a grounding point for grounding.

22. The dipole antenna as claimed in claim 21, wherein said dipole antenna is configured to operate at 2.4 GHz.

23. The dipole antenna as claimed in claim 1, wherein said first radiator and said second radiator are bilaterally symmetrical about a sagittal plane.

24. An electronic device comprising:

a device housing; and a dipole antenna disposed in said device housing, said dipole antenna including a grounding section including first and second grounding portions, each of which has opposite first and second ends, said second end of said first grounding portion being connected electrically to said first end of said second grounding portion, a first radiator section including a first connecting portion extending perpendicularly from said first end of said first grounding portion, and first and second extending portions that transversely extend respectively from said first connecting portion in a direction toward said second end of said first grounding portion, said second extending portion being disposed between said first grounding portion and said first extending portion, and a second radiator section including a second connecting portion extending perpendicularly from said second end of said second grounding portion in a substantially same direction relative to said first connecting portion, and third and fourth extending portions that transversely extend respectively from said second connecting portion toward said first end of said second grounding portion, said fourth extending portion being disposed between said second grounding portion and said third extending portion.

25. The electronic device as claimed in claim 24, wherein said dipole antenna is disposed to extend along a peripheral wall of said device housing.

* * * * *